US006776548B2

(12) United States Patent
Gardner, Jr. et al.

(10) Patent No.: US 6,776,548 B2
(45) Date of Patent: Aug. 17, 2004

(54) COATING APPLICATOR AND METHOD OF USING THE SAME

(75) Inventors: Thomas L. Gardner, Jr., Silverlake, OH (US); Paul A. Smith, Glenview, IL (US); Richard Hackett, Hudson, OH (US); Christopher R. Prebel, Strongsville, OH (US); John J. Ernst, Jr., Arlington Heights, IL (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 10/264,181

(22) Filed: Oct. 3, 2002

(65) Prior Publication Data

US 2003/0063942 A1 Apr. 3, 2003

Related U.S. Application Data

(60) Provisional application No. 60/326,903, filed on Oct. 3, 2001.

(51) Int. Cl.[7] ..... B47K 27/02

(52) U.S. Cl. ..... 401/18; 401/16; 401/38

(58) Field of Search ..... 401/16–18, 34, 401/36–39, 126, 129

(56) References Cited

U.S. PATENT DOCUMENTS

| | | | | |
|---|---|---|---|---|
| 1,868,416 A | | 7/1932 | Hill | |
| 2,070,953 A | | 2/1937 | Morgan | 91/62.6 |
| 2,869,162 A | * | 1/1959 | Dritz | 401/26 |
| 2,887,708 A | | 5/1959 | Kane | 15/136 |
| 2,930,062 A | | 3/1960 | Reimann | 15/132.7 |
| 3,000,355 A | | 9/1961 | Rosenthal | 120/42.4 |
| 3,341,884 A | * | 9/1967 | Pryor | 401/129 |
| 3,377,124 A | | 4/1968 | Matsumoto | 401/198 |
| 4,089,994 A | | 5/1978 | Mattsson et al. | 427/140 |
| 4,198,172 A | | 4/1980 | Meislik | 401/214 |
| 4,251,572 A | | 2/1981 | Herliczek et al. | 427/142 |
| 4,472,462 A | | 9/1984 | Apice et al. | 427/288 |
| 4,522,523 A | | 6/1985 | Vogelsang | 401/126 |

(List continued on next page.)

FOREIGN PATENT DOCUMENTS

| | | | | |
|---|---|---|---|---|
| DE | 3044223 C1 | * | 11/1980 | |
| GB | 349106 | | 5/1931 | |
| GB | 1315639 | | 5/1973 | A45D/34/00 |
| JP | 2000-210612 A | | 8/2000 | B05C/17/00 |
| JP | 2002-225495 A | | 8/2002 | B43L/19/00 |
| WO | WO-89/07053 | * | 8/1989 | |
| WO | WO 9520497 A | | 8/1995 | B43M/11/06 |

OTHER PUBLICATIONS

Copyright 1995 Information Access Company, a Thompson Corporation Company; ASAP Copyright 1995 Chilton Company—Automotive Marketing Jun. 1, 1995 3 pages.

Copyright 1996 Information Access Company, a Thompson Corporation Company; ASAP Copyright 1996 Kay Publishing Company Ltd. (Canada)—Coatings Nov. 21, 1996 5 pages.

Krylon with Leafing Pens the Possibilities are Endless!, ©1997, 1 page Krylon Car Color Touch–Up Paint Marker, 4 pages.

Xterra Parts.Com, Touch Up Paint, 2 pages.

RAABE Corporation, How to Use a Precision Color Paint Pen, 4 pages.

RAABE Corporation, Touch–Up How To, 13 pages.

*Primary Examiner*—David A. Scherbel
*Assistant Examiner*—Huyen Le
(74) *Attorney, Agent, or Firm*—Eryn Ace Fuhrer; Paul B. Katterle; Robert E. McDonald

(57) ABSTRACT

An applicator for applying a coating composition to a substrate. The applicator includes a point applicator and a brush applicator connected to a body having a reservoir holding a coating composition. The point applicator includes an application element movable relative to the body. The brush applicator includes a shaft with a brush extending therefrom. The shaft extends into the reservoir.

21 Claims, 10 Drawing Sheets

U.S. PATENT DOCUMENTS

| | | | | | |
|---|---|---|---|---|---|
| 4,541,552 | A | | 9/1985 | Scheithauer | 222/501 |
| 4,600,327 | A | * | 7/1986 | Guzman | 401/18 |
| 4,712,571 | A | | 12/1987 | Remz et al. | 132/88.7 |
| 4,747,419 | A | | 5/1988 | Flynn et al. | 132/73 |
| 4,783,185 | A | | 11/1988 | Erismann et al. | 401/37 |
| 4,812,071 | A | | 3/1989 | Batra et al. | 401/264 |
| 4,848,947 | A | | 7/1989 | Kremer et al. | 401/206 |
| 4,923,317 | A | | 5/1990 | Bishop et al. | 401/205 |
| D321,717 | S | * | 11/1991 | Hager | D19/36 |
| 5,082,692 | A | | 1/1992 | Cavill | 427/142 |
| 5,388,925 | A | | 2/1995 | Wilcox et al. | 401/261 |
| 5,468,082 | A | | 11/1995 | Hori | 401/4 |
| 5,629,363 | A | | 5/1997 | Abber et al. | 523/161 |
| 5,702,759 | A | | 12/1997 | White et al. | 427/142 |
| 5,738,382 | A | | 4/1998 | Grosskopf et al. | 283/81 |
| 5,746,529 | A | | 5/1998 | Peters et al. | 401/18 |
| 5,783,254 | A | | 7/1998 | Maynard | 427/140 |
| 5,785,746 | A | | 7/1998 | Kito et al. | 106/31.86 |
| D396,884 | S | * | 8/1998 | Davila | D19/36 |
| 5,821,291 | A | | 10/1998 | Blackburn et al. | 524/277 |
| 5,913,630 | A | | 6/1999 | Kelders et al. | 401/126 |
| 6,004,055 | A | | 12/1999 | Cheng | 401/126 |
| 6,010,263 | A | | 1/2000 | White et al. | 401/15 |
| 6,030,298 | A | | 2/2000 | Tate | 473/408 |
| 6,053,650 | A | | 4/2000 | Bennett et al. | 401/208 |
| 6,059,474 | A | * | 5/2000 | Huang | 401/129 |
| 6,065,477 | A | | 5/2000 | Doo | 132/73 |
| 6,126,349 | A | * | 10/2000 | Kelders | 401/36 |
| 6,142,868 | A | | 11/2000 | Pfanstiehl | 457/28 |
| 6,209,548 | B1 | | 4/2001 | Harrison et al. | 132/74.5 |
| 6,254,299 | B1 | | 7/2001 | Russo | 401/259 |
| 6,283,663 | B1 | | 9/2001 | Russo | 401/260 |

* cited by examiner

COATING APPLICATOR AND METHOD OF USING THE SAME

CROSS-REFERENCE TO RELATED APPLICATION

This application claims the benefit of U.S. provisional patent application No. 60/326,903 filed on Oct. 3, 2001, the entirety of which is hereby incorporated by reference.

BACKGROUND OF THE INVENTION

This invention generally relates to precision coating applicators and more particularly to precision coating applicators for repairing blemishes in coated substrates.

Precision coating applicators are utilized for various purposes, including repairing blemishes in coated substrates, as well as adding intricate designs to substrates. Many conventional precision coating applicators utilize a small brush for applying the coating. Such applicators are desirable when applying a coating to a relatively broad area, such as a paint chip, however, when applying a coating to a narrow area, such as a scratch, the brush may not be accurate enough.

More accurate coating applicators are known for applying coatings to narrow areas. Examples of such coating applicators are shown in U.S. Pat. No. 1,868,416 to Hill, U.S. Pat. No. 2,070,953 to Morgan, U.S. Pat. No. 5,783,254 to Maynard, U.S. Pat. No. 6,065,477 to Doo and. U.S. Pat. Nos. 6,254,299 and 6,283,633 to Russo. The Hill, Morgan and Russo patents disclose applicators with sliding nibs for applying lacquer to automotive bodies, while the Maynard and Doo patents disclose applicators having needles or elongated tubes. In addition to the applicators disclosed in the foregoing patents, numerous commercial automotive touch-up paint applicators with sliding nibs have been sold in the U.S. since at least the late 1980's. Examples of such commercial automotive touch-up paint applicators include the KRYLON CAR COLOR and KRYLON TOUCH AND GO touch-up paint applicators sold by Borden in the late 1980's.

It would be desirable to provide a precision coating applicator that can be used for both narrow and broad areas and is easy to use. The present invention is directed to such a precision coating applicator and a method of using the same.

SUMMARY OF THE INVENTION

In accordance with a first embodiment of the present invention, an applicator is provided for applying a coating composition to a substrate. The applicator includes a body having a reservoir for holding the coating composition. A housing is releasably secured to the body. Both a brush applicator and a point applicator are secured to the housing. The brush applicator includes a shaft with a brush extending therefrom. The shaft extends into the reservoir. The point applicator is connected to the reservoir for receiving the coating composition therefrom and includes an application element extending from the housing. The application element is movable relative to the housing.

In accordance with a second embodiment of the present invention, an applicator is provided for applying at least one coating composition to a substrate. The applicator includes a body having at least one reservoir for holding the at least one coating composition. The body has opposing first and second ends. A brush applicator is connected to the first end of the body and includes a shaft with a brush extending therefrom. The shaft extends into the at least one reservoir. A point applicator is connected to the second end of the body for receiving the at least one coating composition from the at least one reservoir. The point applicator includes an application element extending from the housing and being movable relative to the body.

Also provided in accordance with the present invention is a method of repairing blemishes in a paint film using an applicator embodied in accordance with either the first or second embodiments described above, wherein the brush applicator is used to deposit a coating composition in one blemish and the point applicator is used to deposit the coating composition in another blemish.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
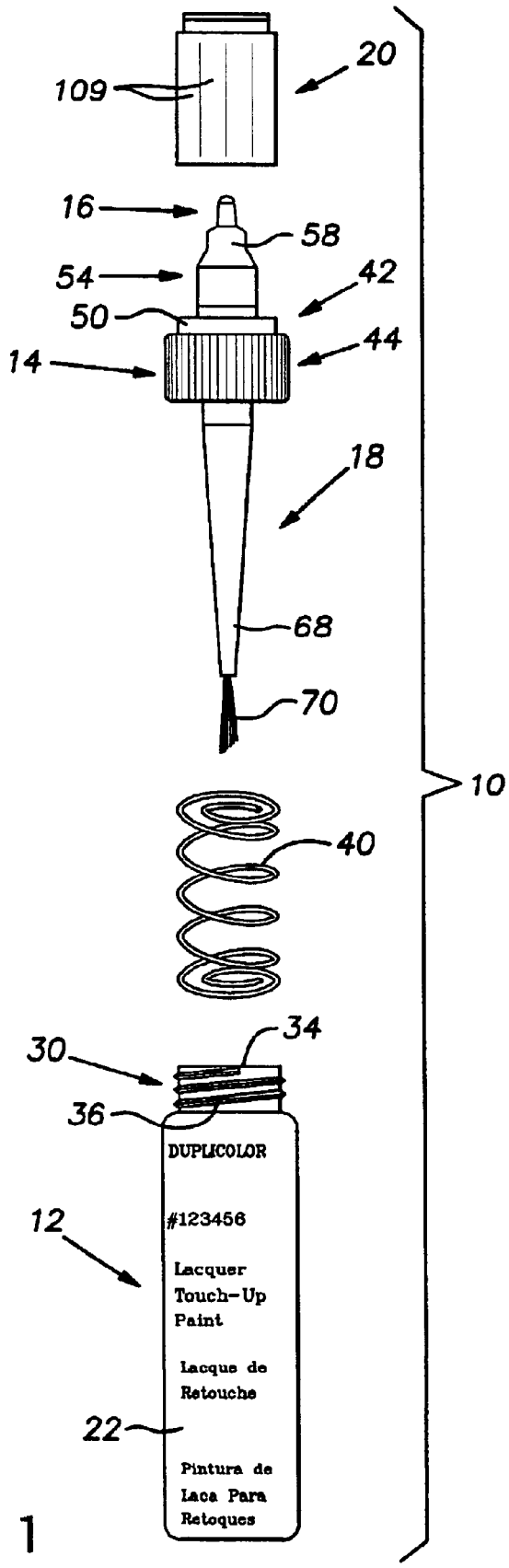
FIG. 1 shows an exploded view of a first coating applicator constructed in accordance with a first embodiment of the present invention.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein with regard to a particular coating or paint composition, the terms "dried appearance", "dried color", and "dried finish" shall respectively mean the appearance, color, and finish of the coating or paint composition when dried.

As used herein, the term "vehicle" shall mean any device or contrivance for carrying or conveying persons or objects, including automobiles, motorcycles, trucks, vans, sport utility vehicles (SUVs), farm equipment, trailers, trains, boats, and ships.

The present invention is directed to a coating applicator and a method of using the same to repair blemishes in coated substrates. The applicator is especially suited for repairing blemishes in vehicles, particularly commercially-available road vehicles that are manufactured in large quantities, such automobiles, motorcycles, trucks, vans, and SUVs. Manufacturers typically produce such road vehicles in a finite number of paint colors. As a result, after-market paint manufacturers are able to provide touch-up paint matching or closely approximating the colors of most commercially-available road vehicles.

Referring now to FIG. 1, there is shown an exploded view of a first coating applicator 10 embodied in accordance with a first embodiment of the present invention. The first coating applicator 10 includes a body 12 connected to an applicator head 14 having both a point applicator 16 and a brush applicator 18. Preferably, the applicator head 14 is covered by a removable cap 20 and a label 22 is secured to the body 12.

Figure 8:
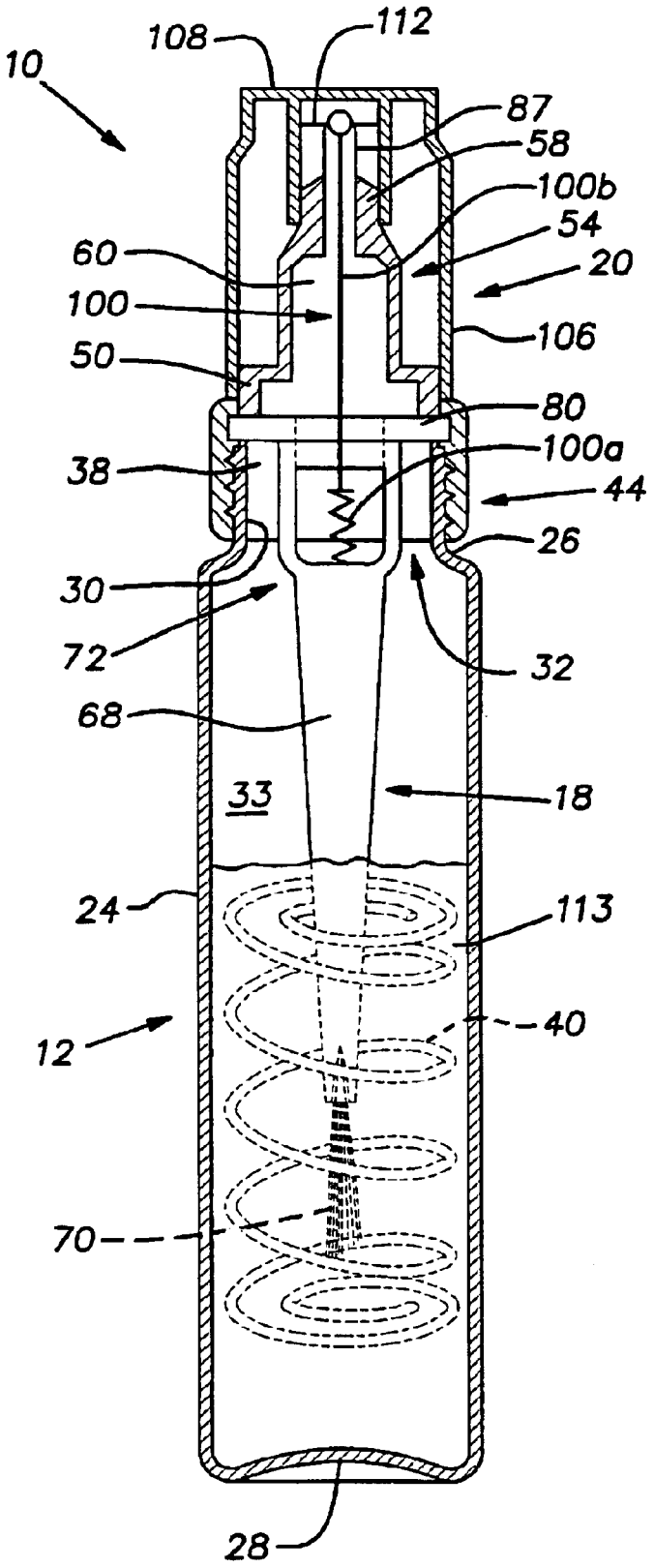
FIG. 8 shows a sectional view of the first coating applicator.

Referring now also to FIG. 8, the body 12 includes a cylindrical side wall 24, a top end wall 26, an opposing bottom end wall 28, and a neck 30. An opening 32 is centrally formed in the top end wall 26. Preferably, the ratio of the combined length of the body 12 and the applicator head 14 to the diameter of the side wall 24 is between about 10:1 and about 1:1, more preferably between about 8:1 and about 2:1, more preferably between about 6:1 and 3:1, still more preferably between about 5:1 and about 4:1. The side wall 24 preferably has a diameter that is between about 0.5 inches and about 2 inches, more preferably between about 0.5 inches and about 1 inch, still more preferably between about 0.75 inches and about 1 inch. The body 12 has a reservoir 33 that preferably holds from about 0.125 fluid ounces to about 2 fluid ounces, more preferably from about 0.25 fluid ounces to about 1 fluid ounce, still more preferably about 0.5 fluid ounces of a coating composition.

The body 12 is composed of a flexible plastic that will permit the side wall 24 to be resiliently deformed in an inward direction to decrease the volume of the reservoir 33 and thereby pressurize the coating composition disposed therein. The entire body 12 may be composed of a clear plastic or a window of clear plastic may be formed in the body 12 to permit a coating composition disposed in the body 12 to be viewed externally. Preferably, the body 12 is composed of an impact modified acrylonitrile-methyl acrylate copolymer available from BP Chemicals as BAREX® 218.

The neck 30 of the body 12 is cylindrical and preferably has a diameter less than the diameter of the side wall 24. The neck 30 has an outer rim 34 defining an outer opening (not shown). An outer surface of the neck 30 has a helical thread 36 formed therein. A passage 38 extends through the neck 30, between the opening 32 in the top end wall 26 and the outer opening.

An agitator 40 is disposed in the reservoir 33 of the body 12. The agitator 40 is preferably a helical metal spring adapted to be reduced in diameter when one or both of the ends is/are twisted. More specifically, the agitator 40 is deformable between an expanded state, wherein the agitator 40 has a diameter greater than the passage 38 in the neck 30, but less than the diameter of the reservoir 33, and a contracted state, wherein the agitator 40 has a diameter less than the passage 38 in the neck 30. In this manner, the agitator 40 may be inserted into the reservoir 33 through the passage 38 when the agitator is in the contracted state. Once the agitator 40 is in the reservoir 33, the agitator 40 resiliently moves to its expanded state, which prevents the agitator 40 from being removed from the reservoir 33 through the neck 30. Since the agitator 40 in the expanded state has a diameter less than the reservoir 33, the agitator 40 is axially movable inside the reservoir 33. When the first coating applicator 10 is shaken, the axial movement of the agitator 40 helps mix the coating composition in the reservoir 33.

Figure 2:
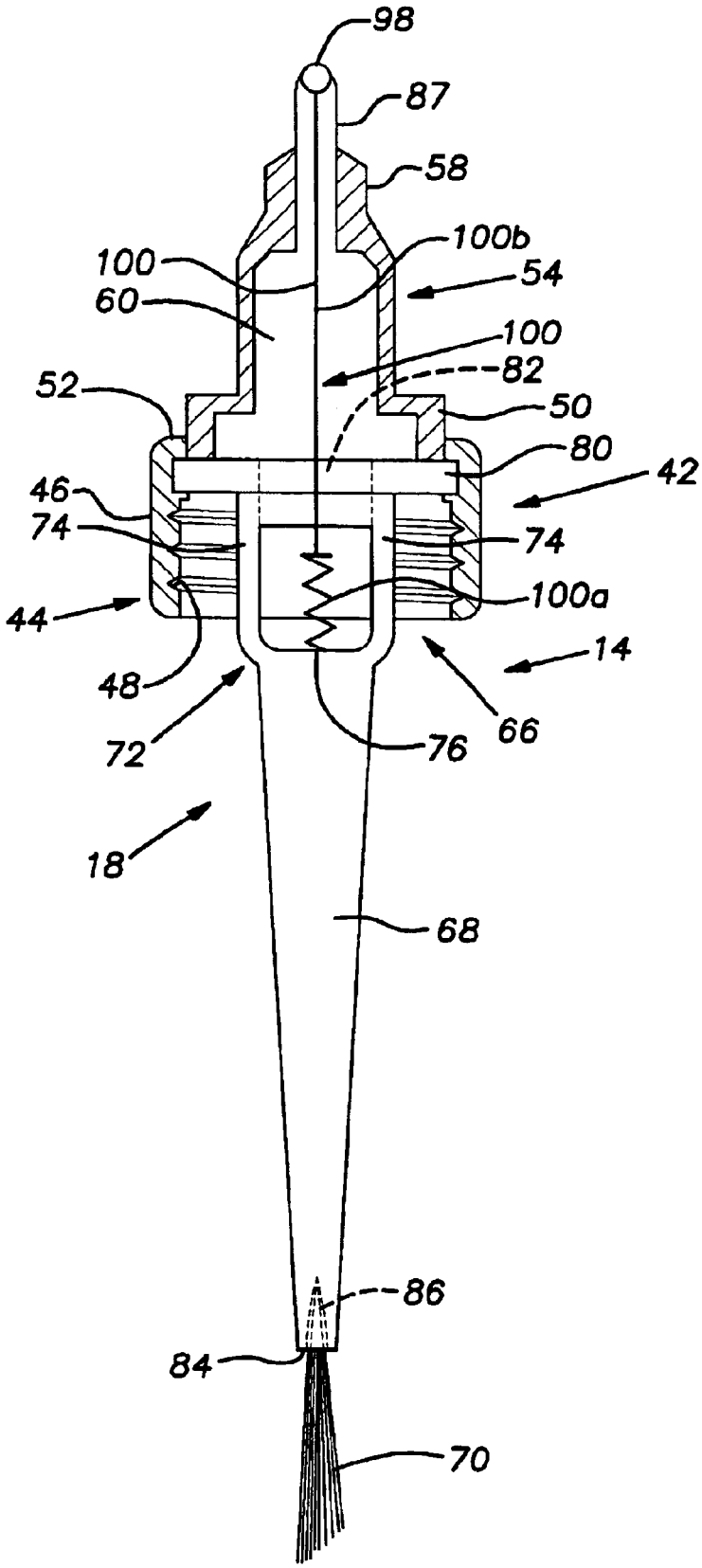
FIG. 2 shows an applicator head of the first coating applicator with a portion cut-away to better show the interior thereof.

Referring now to FIG. 2, the applicator head 14 includes a rigid housing 42 that is preferably composed of a hard plastic, such as high density polyethylene, or polypropylene. The housing 42 includes a base 44 having a cylindrical sidewall 46 with a helical thread 48 formed in an interior surface thereof. The thread 48 is adapted to mate with the thread 36 formed in the neck 30 of the body 12 to secure the applicator head 14 to the body 12. A plurality of vertical ridges are preferably formed in an outside surface of the base 44 to facilitate gripping of the base 44 when the applicator head 14 is threaded to the neck 30 or unthreaded from the neck 30.

A cylindrical step 50 having a diameter less than the base 44 is centrally joined to an end wall 52 of the base 44. A generally cylindrical nozzle 54 having a diameter less than the step 50 is joined to the step 50 and extends outwardly therefrom. An interior bore 56 (see FIG. 3) extends longitudinally through a tip portion 58 of the nozzle 54. The interior bore 56 opens into a cavity 60 extending through the remainder of the nozzle 54 and the step 50.

The brush applicator 18 extends from the base 44 of the applicator head 14 and comprises a body 66 joined to a shaft 68 having a brush 70 extending therefrom. Preferably, the body 66 and the shaft 68 are integrally formed from a plastic that is sufficiently flexible to permit the shaft 68 to be flexed. An example of such a flexible plastic is low density polyethylene.

The body 66 includes a generally U-shaped yoke 72 having a pair of spaced-apart arms 74 extending from a central member 76. An annular mounting disk 80 with a center opening 82 (shown in phantom) is joined to outer ends of the arms 74. An inner end of the elongated shaft 68 is joined to the central member 76 of the yoke 72, while an outer end 84 of the shaft 68 has an opening 86 (shown in phantom) formed therein. The shaft 68 is tapered to have an elongated conical shape, which promotes the quick drainage of coating composition from the shaft 68. An inner end of the brush 70 is secured within the opening 86 in the shaft 68 by glue or other means. The brush 70 is comprised of a plurality of bristles and is configured to have a chisel shape.

The brush applicator 18 is secured to the base 44 of the housing 42 by the mounting disc 80, which is trapped between an innermost turn of the thread 48 and an inner surface of the end wall 52 of the base 44.

Figure 3:
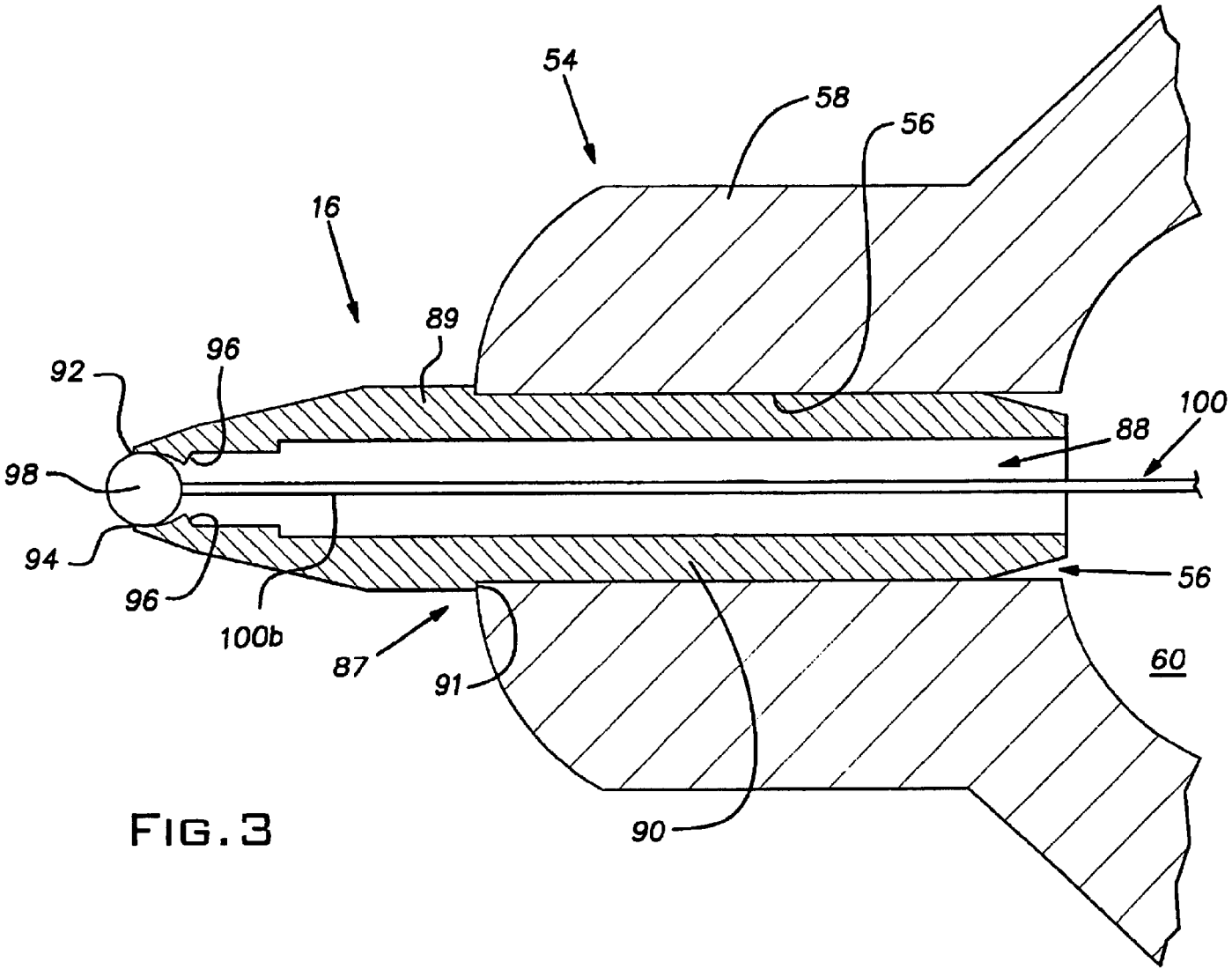
FIG. 3 shows a sectional view of a portion of a roller ball applicator of the first coating applicator.

Referring now to FIG. 3, there is shown a sectional view of the point applicator 16. The point applicator 16 includes a barrel 87 having a passage 88 extending therethrough. The barrel 87 is preferably a tube composed of a metal, such as brass, stainless steel, or an aluminum alloy. The barrel 87 includes an outer end portion 89 joined to an inner end portion 90. The inner end portion 90 has a smaller diameter than the outer end portion 89 at the juncture of the outer and inner end portions 89, 90, thereby forming an inwardly-directed annular ledge 91 (best shown in FIG. 4) at the juncture. The inner end portion 90 is fully disposed in the interior bore 56 of the housing 42 such that the ledge 91 abuts the tip portion 58 of the nozzle 54. The inner end portion 90 is secured in the interior bore 56 by force fitting, glue, or other means. The outer end portion 89 tapers radially inward to a circular rim 92 (best shown in FIG. 4) defining an outlet aperture 94. The tapered shape of the outer end portion 89 permits the point applicator 16 to be positioned at an oblique angle to a substrate upon which the coating composition is to be applied.

Figure 4:
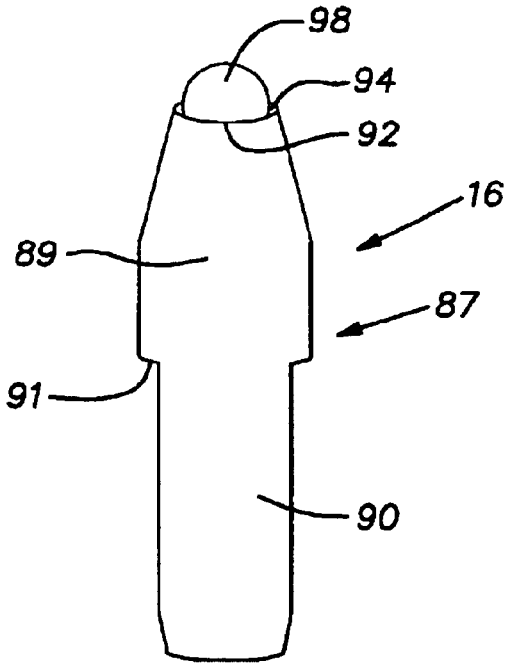
FIG. 4 shows a side view of the roller ball applicator with a circular rim.

Inside the barrel 87, projections 96 extend radially inward from an interior surface of the barrel 87 to diminish the width of the passage 88. The projections 96 are spaced inwardly from the rim 92 to define a socket therebetween. A spherical roller ball 98 is disposed in the socket and is urged against the rim 92 by an outer end of a spring member comprising a spring rod 100. The roller ball 98 is preferably composed of a hard corrosion-resistant metal, such as stainless steel. The roller ball 98 has a diameter larger than the rim 92 and the diminished width of the passage 88 at the projections 96. In this manner, the roller ball 98 is rotatably held within the socket and only a portion of the roller ball 98 extends through the outlet aperture 94 and is disposed exterior to the barrel 87, as shown in FIG. 4.

Figure 5:
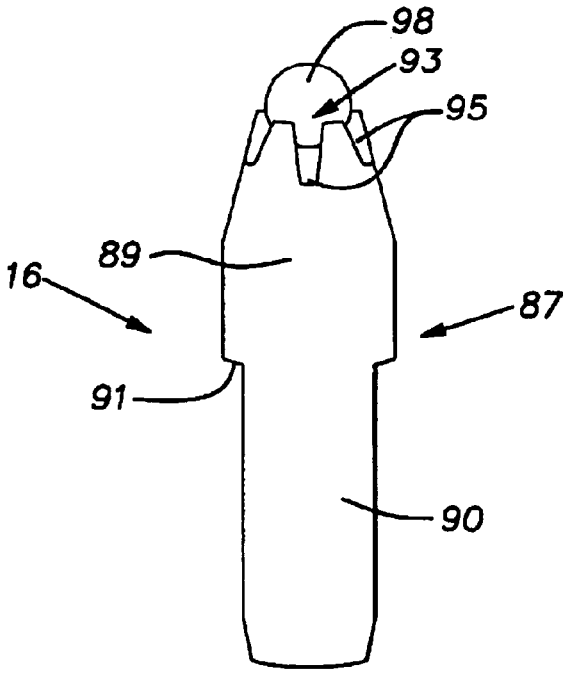
FIG. 5 shows a side view of the roller ball applicator with a crenellated rim.
Figure 6:
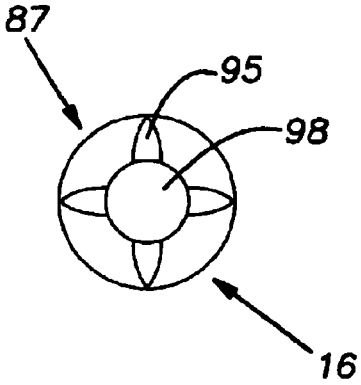
FIG. 6 shows a top view of the roller ball applicator with the crenellated rim.

In lieu of having the circular rim 92, the outer end portion 89 may have a rim 93 with a plurality of notches 95 formed therein so as to be crenulated, as shown in FIGS. 5 and 6. The notches 95 enhance the flow of coating composition around the roller ball 98, which may be desirable if the coating composition has a higher viscosity.

It should also be appreciated that in lieu of having the construction described above with the roller ball 98, the point applicator 16 may be constructed to have a nib slidably disposed in the interior bore 56 of the housing 42. The nib may be a stylus, such as disclosed in U.S. Pat. No. 4,812,071 to Batra (which is hereby incorporated by reference), or a fiberous member such as disclosed in U.S. Pat. No. 3,377,124 to Matsumoto (which is hereby incorporated by reference).

Referring back to FIG. 2, the spring rod 100 is a unitary structure comprising a lower helical spring portion 100*a* joined to an upper elongated rod portion 100*b*. The spring rod is formed from 0.015 inch diameter wire composed of a metal such as carbon steel. Preferably, the spring portion 100*a* is composed of four open coils disposed between three upper closed coils and three lower closed coils. The spring portion 100*a* preferably has a diameter of about 0.250 inches and a length of about 0.375 inches, while the rod portion 100*b* preferably has a length of about 0.906 inches. The rod portion 100*a* of the spring rod 100 extends from its outer end, through the barrel 87 and the cavity 60, and into the yoke 72, through the center opening 82 in the mounting disk 80. The spring portion 100*a* is disposed in the yoke 72, between the arms 74. The lower closed coils of the spring portion 100*a* abut the central member 76.

Figure 7:
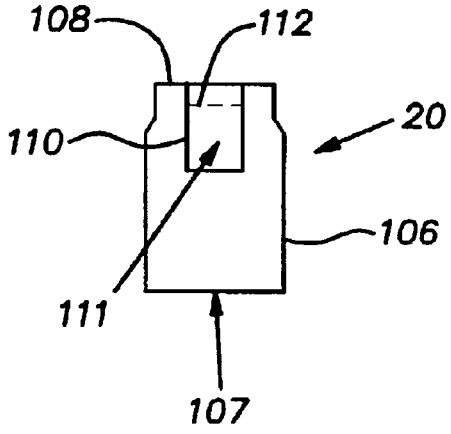
FIG. 7 shows a sectional view of a cap of the first coating applicator.

Referring now to FIG. 7, there is shown a sectional view of the cap 20. The cap 20 is composed of plastic, which may be clear or opaque. The cap 20 includes a cylindrical side wall 106 having a first end defining an enlarged opening 107 and a second end closed by an end wall 108. Preferably, the side wall 106 is configured to facilitate being gripped by a user. For example, the side wall 106 may have a plurality of outer surfaces 109 (shown in FIG. 1) forming a uniform polygon as viewed in cross-section. Inside the cap 20, a tubular retaining sleeve 110 extends downwardly from an interior surface of the end wall 108. The sleeve 110 has an interior void 111 sized to snugly receive the tip portion 58 of the nozzle 54. A ring 112 composed of neoprene may be disposed in the sleeve 110, proximate to, but spaced from, the end wall 108. When the cap 20 is disposed over the point applicator 16 after the point applicator 16 has been used, the protruding portion of the roller ball 98 and the outer end portion 89 of the barrel 87 pass through a small opening in the ring 12. As this occurs, an interior edge defining the opening scrapes excess coating composition off of the roller ball 98 and the outer end portion 89.

Referring now to FIG. 8, there is shown a sectional view of the first coating applicator 10 with the applicator head 14 secured to the body 12 and the cap 20 disposed over the nozzle 54 of the housing 42. The brush applicator 18 extends into the reservoir 33, with the brush 70 being disposed toward the bottom end wall 28. The base 44 of the housing 42 is secured to the neck 30 of the body 12 by the mating threads 36, 48 of the neck 30 and the base 44. The nozzle 54 of the housing 42 extends into the cap 20 through the enlarged opening 107. The tip portion 58 of the nozzle 54 is frictionally held in the retaining sleeve 110 and the step 50 of the housing 42 frictionally engages an interior surface of the side wall 106, around the enlarged opening 107, thereby removably securing the cap 20 to the applicator head 14.

The first coating applicator 10 may be utilized to apply a coating composition 113 to a substrate using the brush applicator 18 and/or the point applicator 16. The coating composition 113 is disposed in the body 12, preferably in an amount sufficient for the coating composition 113 to extend above the brush 70 of the brush applicator 18.

When it is desired to use the brush applicator 18, the first coating applicator 10 is initially shaken to actuate the agitator 40 and mix the coating composition 113. The base 44 of the applicator head 14 is then unscrewed from the neck 30 of the body 12 and the brush applicator 18 is removed from the body 12, with any excess coating composition 113 being scraped off the brush 70 using the outer rim 34 of the neck 30. After the applicator head 14 is removed from the body 12 in the foregoing manner, the applicator head 14 is manipulated to move the brush 70 over the substrate to deposit the coating composition 113 on the substrate. Preferably, the cap 20 is maintained over the nozzle 54 while the applicator head 14 is being removed from the body 12 and manipulated to deposit the coating composition 113 on the substrate.

When it is desired to use the roller ball applicator 116, the first coating applicator 10 is once again shaken to actuate the agitator 40 and mix the coating composition 113. The cap 20 is then removed from the nozzle 54 to expose the roller ball 98. The first coating applicator 10 is preferably inverted or tilted to have the nozzle 54 and the roller ball 98 positioned downward, toward the substrate. Opposing portions of the side wall 24 of the body 12 are then squeezed to pressurize the coating composition 113 in the body 12 and force it to flow between the arms 74 of the yoke 72, through the center opening 82 in the mounting disk 80 of the yoke 72, and into the barrel 87 through the cavity 60. The first coating applicator 10 is then moved downward to place the roller ball 98 in contact with the substrate. While applying a gentle downward force, the first coating applicator 10 is moved over the substrate. The downward force on the first coating applicator 10 moves the roller ball 98 toward the body 12, against the bias of the spring rod 100, thereby permitting the coating composition 113 in the barrel 87 to flow around the roller ball 98, exit the first coating applicator 10 through the outlet aperture 94 and be deposited on the substrate. The movement of the first coating applicator 10 over the substrate rotates the roller ball 98, which spreads the coating composition 113 on the substrate. In this manner, the roller ball 98 controls both the flow of the coating composition from the point applicator 16 and its deposit on the substrate.

In one embodiment of the present invention, the coating composition 113 held in the body 12 is a touch-up paint composition formulated to have a dried appearance that corresponds to the appearance of a dried paint film on a commercially-available vehicle. More specifically, the touch-up paint composition is formulated with pigments and/or dyes to have a dried color that is the same or is substantially similar to the color of the vehicle paint film. This "color matching" may be performed with a spectrophotometer or calorimeter and preferably a computer, using known color matching processes. An example of color matching process that may be used is disclosed in U.S. Pat. No. 4,887,217 to Sherman, et al., which is assigned to the assignee of the present invention, and is hereby incorporated by reference.

Although the touch-up paint composition and the vehicle paint film have the same or substantially similar color, the touch-up paint composition may have a different formulation than the vehicle paint composition from which the vehicle paint film is derived. For example, the touch-up paint composition is typically a solvent-borne composition, while the vehicle paint composition may be a latex composition, or a non-aqueous dispersion.

Generally, the touch-up paint composition comprises a solvent carrier, a resin binder, and pigment. The solvent carrier typically comprises a mixture of organic solvents, such as methyl ethyl ketone, methyl isobutyl ketone, toluene, isopropyl alcohol, ethanol, and ethyl 3-ethoxy propionate. The resin binder typically comprises an acrylic resin or a vinyl-acrylic resin and nitrocellulose. The pigment includes one or more colorant pigments and an opacifying pigment, such as titanium dioxide. The pigment may also include metal flakes, such as aluminum and silver flakes.

The touch-up paint composition typically comprises from about 2 to about 8.5 weight percent pigment, based on the total weight of the touch-up paint composition. Total solids of the touch-up paint composition typically comprise from about 23 to about 31.5 weight percent of the total weight of the touch-up paint composition.

In another embodiment of the present invention, the coating composition 113 held in the body 12 is a touch-up primer composition for application over a metal and/or plastic substrate. The touch-up primer composition provides intercoat adhesion between the surface of the substrate and a decorative/protective base coat, such as a layer of the touch-up paint composition described above. The touch-up primer composition also fills in minor flaws in the surface of the substrate, which upon sanding, renders a smooth surface for application of the top coat.

Generally, the touch-up primer composition comprises a solvent carrier, a resin binder, and pigment. The solvent carrier typically comprises a mixture of organic solvents, such as methyl ethyl ketone, methyl isobutyl ketone, toluene, isopropyl alcohol, ethanol, and ethyl 3-ethoxy propionate. The resin binder typically comprises an oil-modified alkyd, such as a coconut oil modified alkyd resin, and nitrocellulose. The pigment includes an opacifying pigment, such as titanium dioxide, and typically a filler pigment, such as calcium carbonate. The pigment may also include a colorant pigment, such as carbon black. The pigment also preferably includes an anti-corrosion pigment for preventing the corrosion of metal substrates. Examples of such anti-corrosion pigments include zinc phosphate, zinc phospho oxide, strontium phosphate, zinc molybdate, zinc chromate, strontium chromate, barium chromate, and phosphosilicates. Preferably, the anti-corrosion pigment comprises zinc.

The touch-up primer composition typically comprises from about 17 to about 19.5 weight percent pigment, based on the total weight of the touch-up primer composition. Total solids of the touch-up primer composition typically comprise from about 34 to about 37 weight percent of the total weight of the touch-up primer composition.

In another embodiment of the present invention, the coating composition 113 held in the body 12 is a touch-up top coating composition for application over a base coat, such as a layer of the touch-up paint composition described above. The touch-up top coating is transparent and provides resistance to outdoor weathering, enhances the depth of color of the base coat, and provides a smooth and glossy finish.

Generally, the touch-up top coating composition comprises a solvent carrier and a resin binder. The touch-up top coating composition is typically free, or substantially free, of pigment. The solvent carrier typically comprises a mixture of organic solvents, such as methyl ethyl ketone, methyl isobutyl ketone, toluene, isopropyl alcohol, ethanol, and ethyl 3-ethoxy propionate. The resin binder typically comprises an acrylic resin or a vinyl-acrylic resin and a cellulose ester, such as cellulose acetate butyrate.

Total solids of the touch-up top coating composition typically comprise from about 28 to about 31 weight percent of the total weight of the touch-up top coating composition.

The viscosities of the touch-up paint composition, the touch-up primer composition and the touch-up top coating composition depend on the precise construction of the point applicator 16 and may be adjusted as required, using solvents, as is well known in the art.

The label 22 is preferably a multipanel label. As used herein the term "multipanel label" shall mean a label comprising at least two panels, wherein one panel can be folded over the other panel. There are numerous multipanel label designs known in the art that can be used for the label. Examples of multipanel label designs known in the art include U.S. Pat. No. 1,273,105 to Van Dyke, et al., U.S. Pat. No. 2,706,865 to Miller, U.S. Pat. No. 4,323,608 to Denny et al., U.S. Pat. No. 4,621,837 to Mack, and U.S. Pat. No. 5,738,382 to Grosskopf et al., all of which are hereby incorporated by reference.

Figure 9:
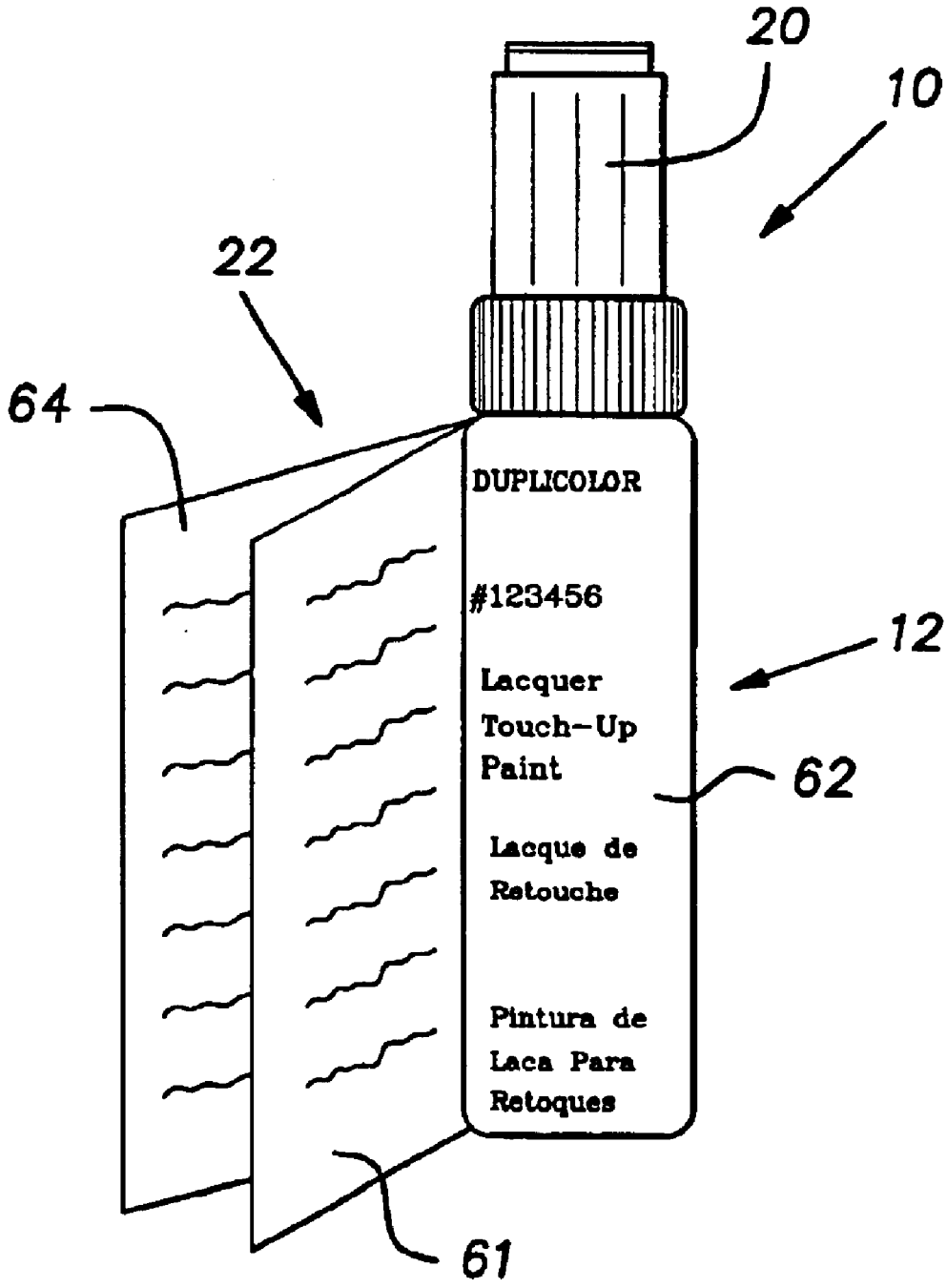
FIG. 9 shows the first coating applicator with intermediate and outer panels of a multipanel label pivoted outwardly.

Referring now to FIG. 9, the label 22 has at least one intermediate panel 61 disposed between an inner panel 62 and an outer panel 64. The inner panel 62 has inner and outer surfaces. The inner surface of the inner panel 62 is coated with a layer of adhesive that secures the inner panel to the side wall 24 of the body 12, while the outer surface of the inner panel 62 is printed with an inner set of information. The intermediate panel 61 has inner and outer surfaces printed with first and second intermediate sets of information, respectively. The outer panel 64 includes an outer surface printed with an outer set of information and an inner surface printed with a third intermediate set of information. The outer panel 64 extends around the body 12, over the intermediate and inner panels 61, 62. An outer edge or fold of the outer panel 64 may be fixedly or releasably secured to an inner edge or fold of the outer panel 64 or to the inner panel 62. If the outer edge or fold is fixedly secured, a tear strip may be formed in the outer panel 64, toward one of the folds or edges.

The intermediate panel 61 and the inner panel 62 are accessed by releasing the outer edge or fold of the outer panel 64 or pulling the tear strip to sever the outer panel 64. The outer panel 64 may then be unrolled from the reservoir and folded outwardly. With the outer panel 64 so positioned, all of the sets of information on the intermediate, inner, and outer panels 61, 62, 64 may be accessed by an individual. If necessary, the intermediate panel 61 may be pivoted to provide a better view of one of the sets of information.

The label 22 is especially suited for providing information about the coating composition 113 in multiple languages, as is required or is desirable in certain countries and regions of the World, such as the U.S., Canada, Mexico, and the European Union. In one embodiment of the present invention, the outside surface of the outer panel has a color approximating the color of the coating composition, and the outer set of information printed thereon includes: (i) a trademark designating the source of the coating composition, (ii) a description of the coating composition in three different languages, (iii) a batch number for the coating composition, and (iv) a warning in the three languages to read instructions inside the label 22. The inner set of information printed on the outer surface of the inner panel 62 is similar to the outer set of information and includes: (i) the trademark designating the source of the coating composition, (ii) a description of the coating composition in the three languages, (iii) the batch number for the coating composition, and (iv) information in the three languages on how to obtain medical emergency information about the coating composition via telephone. The first, second, and third intermediate sets of information respectively include versions in the three languages of the following set of information: (i) instructions on how to use the first coating applicator 10 to apply the coating composition, (ii) safety information and warnings, (iii) a list of regulated substances included in the coating composition, and (iv) first aid information. If it is desired to use more than three languages, the label 22 may be modified to include additional intermediate panels containing the instructions, safety information, list of regulated substances, and first aid information in the additional languages.

Figure 10:
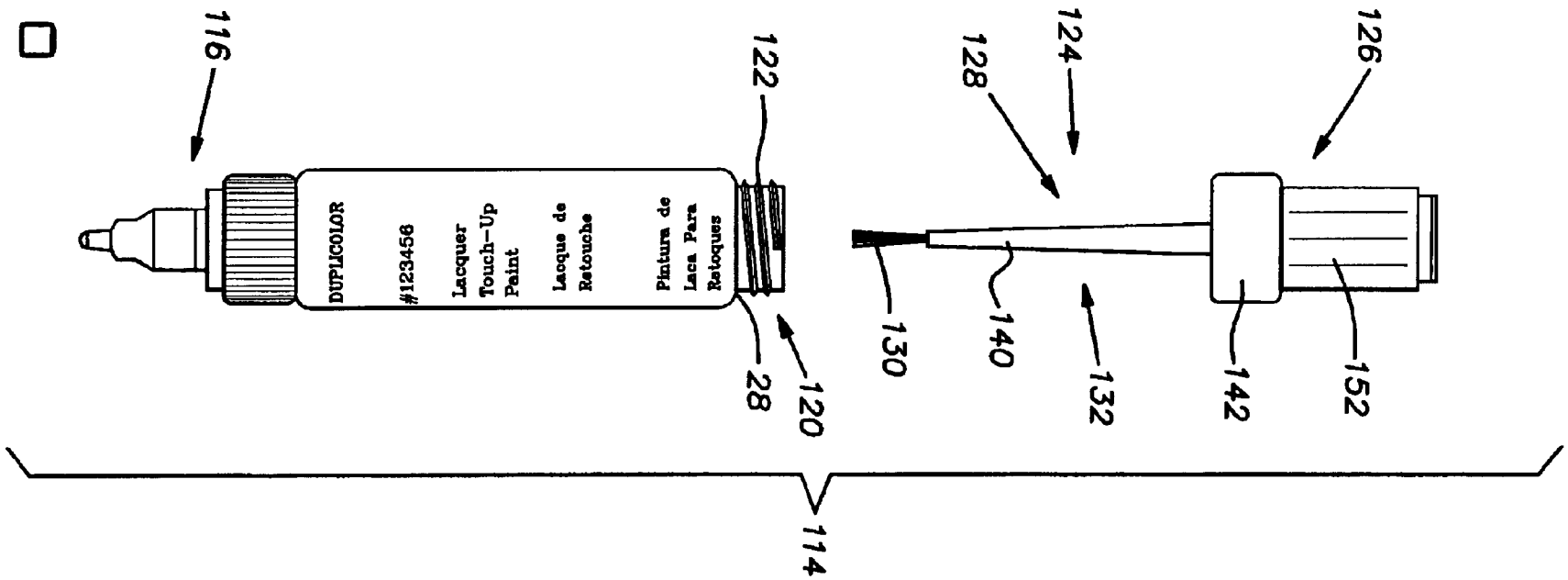
FIG. 10 shows a partially exploded view of a second coating applicator constructed in accordance with another embodiment of the present invention.
Figure 12:
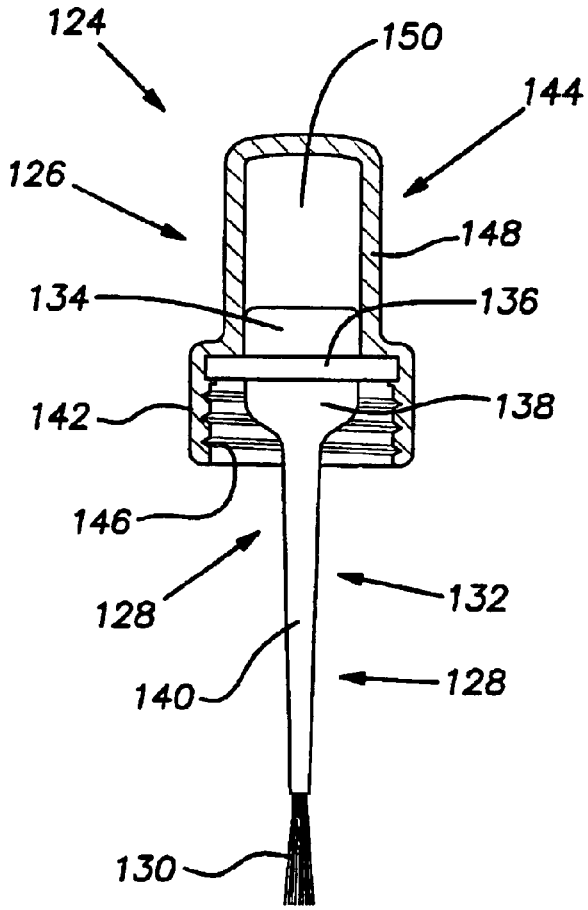
FIG. 12 shows a sectional view of a brush applicator of the second coating applicator.
Figure 11:
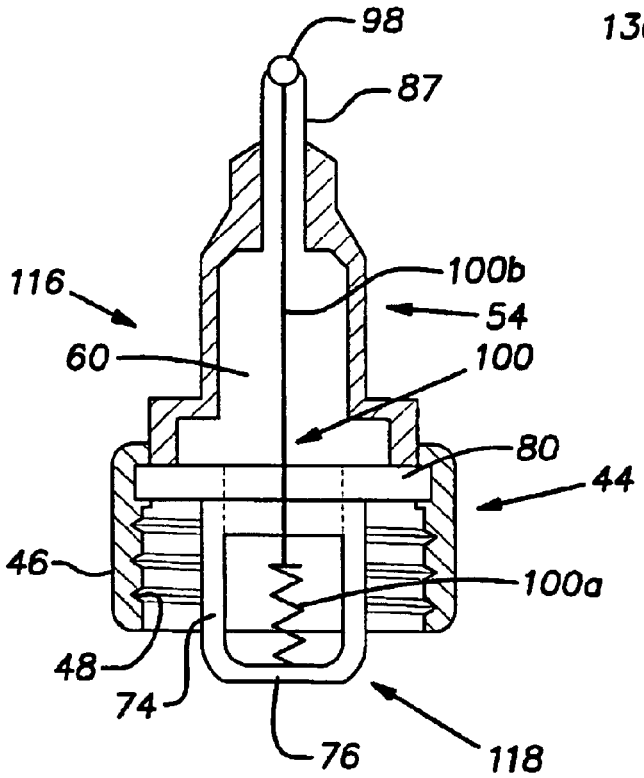
FIG. 11 shows an applicator head of the second coating applicator with a portion cut-away to better show the interior thereof.

Referring now to FIGS. 10–12, there is shown a second coating applicator 114 constructed in accordance with another embodiment of the present invention. The second coating applicator 114 has the same construction as the first coating applicator 10 embodied in accordance with the first embodiment, except for the differences described below. The second coating applicator 114 has an applicator head 116, which has the same construction as the applicator head 14, except the applicator head 116 has a retainer 118 (shown in FIG. 11) instead of the brush applicator 18. The retainer 118 has the same construction as the body 66 of the brush applicator 18 and abuts the spring portion 100*a* of the spring rod 100 in the same manner as the body 66. It should be appreciated that the applicator head 116 may be constructed so as to be fixedly secured to the body 12 instead of being removably secured to the body 12.

The bottom end wall 28 of the body 12 has an opening (not shown) centrally formed therein. A second neck 120 is joined to the bottom end wall 28 around the opening. The second neck 120 is cylindrical and preferably has a diameter less than the diameter of the body 12. An outside surface of the second neck 120 has a helical thread 122 formed therein. A passage (not shown) extends through the second neck 120 and is in communication with the opening in the bottom end wall 28 of the body 12.

The second coating applicator 114 includes a brush applicator 124 removably secured to the second neck 120. The brush applicator 124 includes a cap 126 secured to a brush assembly 128 having a brush 130 extending from an elongated body 132. As best shown in FIG. 12, the body 132 preferably includes a cylindrical head portion 134 joined at an annular flange 136 to a tapered middle portion 138, which extends into an elongated cylindrical shaft 140. Inner ends of the brush 130 are secured inside the shaft 140 by glue or other means. Preferably, the body 132 is composed of a plastic of sufficient flexibility to permit the shaft 140 to be flexed.

The cap 126 includes a cylindrical mounting flange 142 joined to a generally cylindrical upper grip portion 144. An inside surface of the mounting flange 142 has a helical thread 146 formed therein corresponding to the thread 122 on the second neck 120. The upper grip portion 144 includes a side wall 148 defining an inner void 150 which snugly receives the base portion 134 of the brush assembly 128. The brush assembly 128 is secured to the cap 126 by the annular flange 136, which is trapped between the upper grip portion 144 and an innermost turn of the thread 146 in the mounting flange 142. Preferably, the side wall 148 of the upper grip portion 144 is configured to facilitate being gripped by a user. For example, the side wall 148 may have a plurality of outer surfaces 152 forming a uniform polygon as viewed in cross-section.

When the brush assembly 124 is not being used, the cap 126 is threadably secured to the second neck 120 by the thread 146 in the mounting flange 142 of the cap 126, which mates with the thread 122 of the second neck 120. The brush assembly 128 extends through the second neck 120 and into the reservoir 33 of the body 12 so as to place the brush 130 in contact with the coating composition disposed therein. When it is desired to use the brush applicator 124, the cap 126 is unscrewed from the second neck 120 and pulled away from the body 12, thereby moving the brush assembly 128 out of the body 12, through the second neck 120, and into the outside environment for use on a substrate.

It should be appreciated that instead of having a single reservoir, the second coating applicator 114 may have a pair of reservoirs, with a first reservoir being in fluid communication with the roller ball applicator 116 and a second reservoir being in communication with the brush applicator 124. The first and second reservoirs may contain the same coating composition. Alternately, the first and second reservoirs may contain different coating compositions. For example the first reservoir may contain a paint composition, while the second reservoir may contain a transparent top coating composition. In such an embodiment with two reservoirs and two different coating compositions, the second coating applicator 114 may be provided with the applicator head 14 of the first embodiment, instead of the applicator head 116. In this manner, the second coating applicator 114 would have two brush applicators and one point applicator.

The method of the present invention utilizes one or more applicators having the construction of either the first coating applicator 10 or the second coating applicator 114 to repair a blemish in a paint film on a substrate, which may be composed of metal or plastic. The blemish may be a scratch, chip or other defect, wherein one or more layers of the paint film has been removed or damaged so as to break the planar surface of the paint film. The first step in repairing the blemish is ascertaining the nature of the blemish, i.e., determining the size of the blemish, the number of coatings in the paint film removed or damaged by the blemish, and whether any rust has formed in the blemish. Next the type(s) of coating(s) needed to repair the blemish is/are determined. Based on the size and depth of the blemish and the nature and condition of the paint film on the substrate, one or more of a primer coating, a base coating, and a clear top coating may be selected. If the blemish is somewhat large, such as a chip, and extends down to the substrate, and the paint film on the substrate includes a clear top layer, then a primer coating, a base coating, and a clear top coating may all be selected. If the blemish is small, such as a thin scratch, and the blemish only affects a base layer (and a clear top layer if there is one), one or both of a base coating and a clear top coating may be selected. Typically, a base coating is selected, along with a clear top coating if the paint film has a clear top layer. If, however, the paint film on the substrate is old and highly oxidized, it may be difficult to match the base layer of the paint film with a base coating. In such an event, just a clear top coating may be selected to seal the scratch.

If a base coating is to be used to repair the blemish, the base coating is selected to have a color that matches or closely approximates the color of the base layer of the paint film on the substrate. If a primer coating is to be used to repair the blemish, the primer coating is preferably selected to have a color that will provide good hiding when used in combination with the base coating. For example, if a black base coat is used, a black primer coat should be selected, whereas if a yellow base coat is used, a white or a light gray primer coat should be selected.

Figure 13:
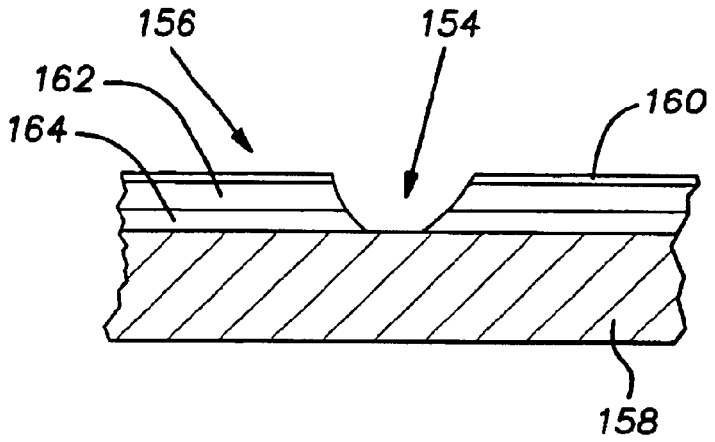
FIG. 13 shows a schematic view of a blemish in a paint film on a substrate.
Figure 17:
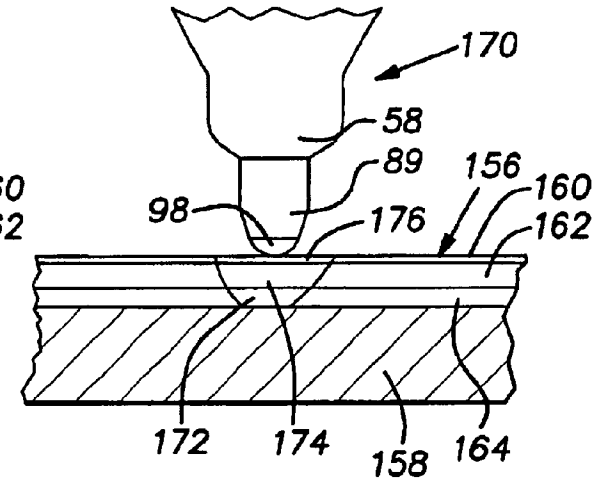
FIGS. 15–17 show partial schematic views of coating applicators being used to repair the blemish in the substrate.
Figure 16:
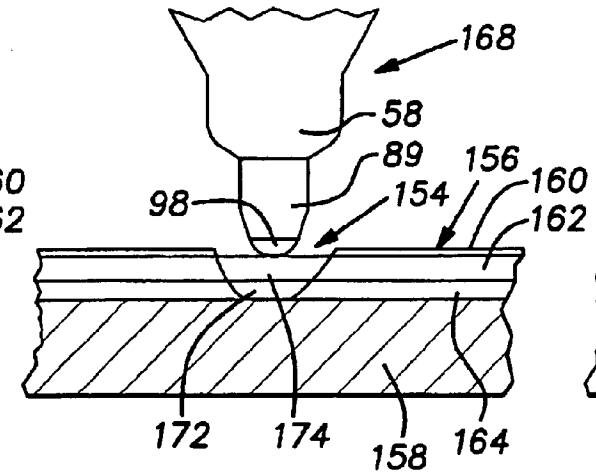
Figure 15:
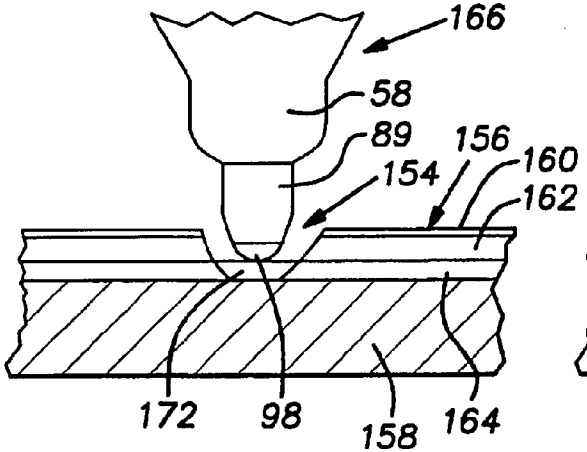

The method of the present invention will now be described. FIG. 13 shows a blemish 154 in a paint film 156 on a substrate 158, such as a body part of an automobile. The paint film 156 includes a clear top layer 160, a colored base layer 162, and a primer layer 164. The blemish 154 is a chip extending down to the substrate 158. After inspecting the blemish 154, it is determined that a primer coating, a base coating, and a clear top coating will be needed. Appropriate colors for the primer coating and the base coating are determined based on the color of the base layer 162 of the paint film 156. Applicators 166, 168, 170 (portions of which are shown in FIGS. 15–17) respectively containing the primer coating, the base coating, and the clear top coating are then obtained. The applicators 166–170 have the same construction as the first coating applicator 10 described above. It should be appreciated, however, that applicators having the same construction as the second coating applicator 114 may have been selected instead.

The next step in repairing the blemish 154 is cleaning the paint film 156 in and around the blemish 154 to remove any debris, such as dirt, rust, oil, or salt spray that may be deposited thereon. A soft cloth with a detergent composition may be used to remove loosely adhering debris, while a glass fiber brush may be used to remove more firmly adhering debris. Sandpaper may be used to remove any rust on the substrate 158.

Figure 14:
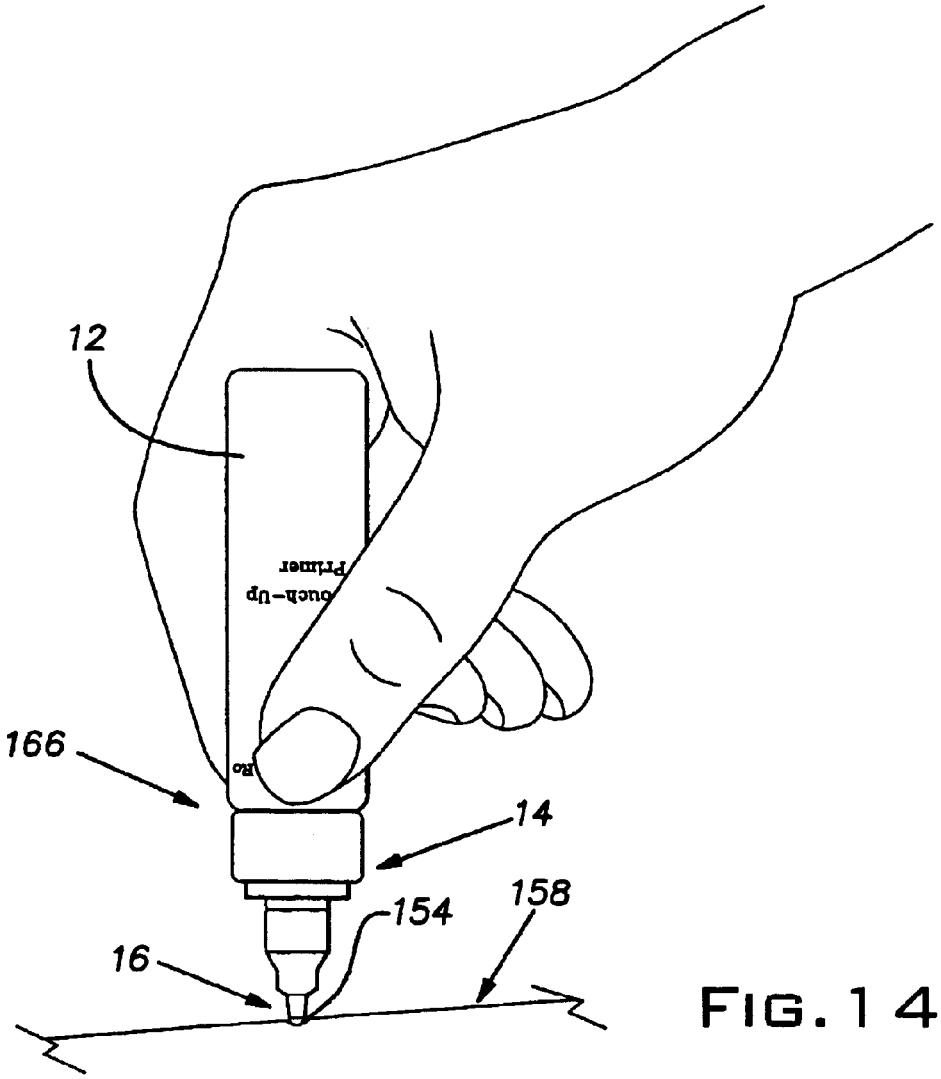
FIG. 14 shows a schematic view of a coating applicator being manipulated to deposit a primer touch-up coating to the blemish in the substrate.

With all debris removed from the paint film 156 in and around the blemish 154, the coatings may then be applied, beginning with the primer coating. The applicator 166 is vigorously shaken for about a minute to ensure pigment and extenders in the primer coating are thoroughly dispersed. The cap 20 is removed from the applicator 166. As shown in FIG. 14, the applicator 166 is then preferably inverted or tilted to have the applicator head 14 positioned downward, toward the substrate 158, and opposing sides of the body 12 are squeezed to pressurize the primer coating in the body 12. With the applicator head 14 so positioned, the roller ball 98 is placed in the blemish 154 so as to be in contact with the substrate 158. While applying a force on the applicator 166 directed toward the substrate 158, the applicator 166 is moved over the substrate 158 to move the roller ball 98 within the blemish 154. As a result of the force, the roller ball 98 is pushed toward the body 12, against the bias of the spring member 100, thereby permitting the primer coating from the body 12 to flow around the roller ball 98, exit the applicator 166 through the outlet aperture 94 and be deposited on the substrate 158. The movement of the applicator 166 over the substrate 158 rotates the roller ball 98, thereby spreading the primer coating on the substrate 158 to form a primer touch-up layer 172 in the blemish 154, as shown in FIG. 15.

After the primer touch-up layer 172 has dried, the applicator 168 containing the base coating is utilized. The applicator 168 is vigorously shaken for about a minute to ensure pigment and extenders in the base coating are thoroughly dispersed. The cap 20 is removed from the applicator 168. The applicator 168 is then preferably inverted or tilted to have the applicator head 14 positioned downward, toward the substrate 158, and opposing sides of the body 12 are squeezed to pressurize the base composition in the body 12. With the applicator head 14 so positioned, the roller ball 98 is placed in the blemish 154 so as to be in contact with the primer touch-up layer 172. While applying a force on the applicator 168 directed toward the primer touch-up layer 172, the applicator 168 is moved over the primer touch-up layer 172. In the same manner as with the applicator 166, the base coating is dispensed from the applicator 168 to form a base touch-up layer 174 on the primer touch-up layer 172 in the blemish 154, as shown in FIG. 16. If the primer touch-up layer 172 and the base touch-up layer 174 do not substantially fill the blemish 154, additional base touch-up layers may be added as needed to substantially fill the blemish 154, with any such additional base touch-up layer being added only after the preceding base touch-up layer has dried.

After the base touch-up layer 174 has dried, the applicator 170 is utilized. The applicator 170 does not need to be shaken because the clear top coating contains little if any pigments and extenders. The cap 20 from the applicator 170 is removed from the applicator 170. The applicator 170 is then preferably inverted or tilted to have the applicator head 14 positioned downward, toward the substrate 158, and opposing sides of the body 12 are squeezed to pressurize the clear top coating in the body 12. With the applicator head 14 so positioned, the roller ball 98 is placed in the blemish 154 so as to be in contact with the base touch-up layer 174. While applying a force on the applicator 170, directed toward the base touch-up layer 174, the applicator 170 is moved over the base touch-up layer 174. In the same manner as with the applicators 166, 168, the top coating is dispensed from the applicator 170 to form a top touch-up layer 176 on the base touch-up layer 174, as shown in FIG. 17. Once the top touch-up layer 176 is dried, the paint film 156 in and around the blemish 154 may be cleaned and buffed, thereby completing the repair of the paint film 156.

The applicators 166, 168, 170 may be packaged together, along with other items, such as sandpaper, to form a complete scratch repair kit, which may be offered to consumers in retail stores.

The first and second coating applicators 10, 114 embodied in accordance with the present invention provide important benefits over conventional applicators. The point applicator 16 in both the first and second coating applicators 10, 114 permits a coating to be deposited in a blemish in a coated substrate in a controlled and accurate manner. More specifically, the roller ball 98 controls the amount of coating being dispensed and accurately guides the deposit of the coating into the blemish in the coated substrate. In this manner, the point applicator 16 can deposit a coating in a thin scratch formed in a paint film, with little or no overlap onto the surrounding portions of the paint film, thereby making the repaired scratch difficult to detect. In addition to having the foregoing benefit of the point applicator 16, the first and second coating applicators 10, 114 further have the benefit of the brush applicators 18, 124, which permit larger amounts of coating to be quickly applied to a blemish. This additional benefit is especially helpful for larger blemishes. For example, if a substrate has a large blemish, such as the size of a quarter, the brush applicators 18, 124 may be used to quickly deposit a large amount of a coating in the blemish to cover all of the blemish except for a thin outer periphery. The point applicator 16 can then be used to accurately deposit the coating in the thin outer periphery, with little or no overlap.

The first and second coating applicators 10, 114 of the present invention are especially suited for applying touch-up coatings to vehicles, appliances, and machinery; however, the first and second coating applicators 10, 114 may also be used to apply nail polish to cuticles, or to apply correction fluid to documents.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. An applicator for repairing a blemish in a paint film on a commercially-available vehicle, said applicator comprising:

a coating composition selected from the group consisting of:

a primer composition comprising an anti-corrosion pigment;

a paint composition formulated to have a dried color that is substantially similar to the dried color of the paint film on the vehicle; and a transparent top coating composition;

a body having a reservoir containing the coating composition; and a roller ball applicator connected to the body to receive the coating composition from the reservoir, said roller ball applicator comprising:

a barrel having a passage extending therethrough, said barrel having an outer end with a rim defining an outlet aperture; and a roller ball rotatably disposed in the passage and partially extending through the outlet aperture.

2. The applicator of claim 1, wherein the roller ball applicator further comprises a spring member disposed in the passage and urging the roller ball against the rim.

3. The applicator of claim 1, further comprising a multipanel label secured to the body, said multipanel label containing sets of information about the coating composition.

4. The applicator of claim 3, wherein the label comprises inner, intermediate and outer panels, said intermediate panel being disposed between the inner and outer panels when the label is in a folded position.

5. The applicator of claim 3, wherein the sets of information are in different languages.

6. The applicator of claim 1, wherein the coating composition is the paint composition, and wherein the label comprises an outer panel with an outer surface having a color similar to the color of the paint composition.

7. The applicator of claim 1, wherein the body comprises a cylindrical side wall composed of a flexible plastic to permit the side wall to be resiliently deformed in an inward direction to pressurize the coating composition in the reservoir.

8. The applicator of claim 1, further comprising a brush applicator connected to the body and having a shaft with a plurality of bristles secured thereto, said shaft extending into the reservoir.

9. The applicator of claim 8, wherein the applicator further comprises a housing releasably secured to the reservoir, and wherein the roller ball applicator and the brush applicator extend from the housing in opposite directions.

10. The applicator of claim 9, wherein the housing comprises a nozzle joined to a base having a cylindrical side wall, said side wall having an interior surface with a helical interior thread formed therein.

11. The applicator of claim 10, wherein the body comprises a neck having an outer surface with a helical outer thread formed therein, said neck being disposed in the base of the housing, with the outer thread of the neck mating with the interior thread of the housing, thereby releasably securing the body to the housing.

12. The applicator of claim 11, wherein the barrel is a metal tube, and wherein the barrel extends through the nozzle of the housing.

13. The applicator of claim 9, wherein the roller ball applicator further comprises a spring member disposed in the passage of the barrel and extending between the roller ball and the brush applicator, said spring member urging the roller bail against the rim.

14. The applicator of claim 13, wherein the brush applicator further comprises an annular mounting disk joined to the shaft by a generally U-shaped yoke, said mounting disk being secured within the housing.

15. The applicator of claim 14, wherein the spring member has an inner end disposed against the yoke of the brush applicator.

16. The applicator of claim 1, wherein the reservoir is disposed at a first end of the body and wherein the body further comprises a second reservoir disposed at a second end of the body, said second reservoir containing a second coating composition, wherein the second coating composition is selected from the group consisting of:

a primer composition comprising an anti-corrosion pigment;

a paint composition formulated to have a dried color that is substantially similar to the dried color of the paint film on the vehicle; and a transparent top coating composition.

17. The applicator of claim 16, further comprising a brush applicator connected to the body and having a shaft with a plurality of bristles secured thereto, said shaft extending into the second reservoir.

18. The applicator of claim 17, wherein the body comprises a first neck disposed at a first end and a second neck disposed at a second end, and wherein the brush applicator and the roller ball applicator are releasably secured to the first and second necks respectively.

19. A method of repairing blemishes in a paint film on a substrate, said method comprising the steps of:

(a) providing an applicator comprising:

a coating composition;

a body having a reservoir containing the coating composition;

a brush applicator releasably secured to the body and having a shaft with a brush extending therefrom, said shall extending into the reservoir, and a point applicator connected to the body to receive the coating composition from the reservoir, said point applicator comprising an application element movable relative to the body;

(b) removing the brush applicator from the body;

(c) contacting a first one of the blemishes with the brush to deposit the coating composition therein; and (d) contacting a second one of the blemishes with the application element to deposit the coating composition therein.

20. The method of claim 19, further comprising the step of cleaning the paint film in and around the blemishes before the coating composition is deposited in the blemishes.

21. The method of claim 19, wherein the substrate is a body part of a commercially-available vehicle, and wherein the coating composition is a paint composition formulated to have a dried color that is substantially similar to the dried color of the paint film on the vehicle.

* * * * *

UNITED STATES PATENT AND TRADEMARK OFFICE

CERTIFICATE OF CORRECTION

PATENT NO. : 6,776,548 B2
APPLICATION NO. : 10/264181
DATED : August 17, 2004
INVENTOR(S) : Thomas J. Gardner, Jr. et al.

It is certified that error appears in the above-identified patent and that said Letters Patent is hereby corrected as shown below:

Claims

Claim 18, Column 15, Line 14, delete “shall”, insert --shaft--.

Signed and Sealed this
Eleventh Day of August, 2015

Michelle K. Lee

Michelle K. Lee
*Director of the United States Patent and Trademark Office*